US007124531B1

(12) United States Patent
Florence et al.

(10) Patent No.: US 7,124,531 B1
(45) Date of Patent: Oct. 24, 2006

(54) METHOD AND APPARATUS FOR SAFE OPERATION OF AN ELECTRONIC FIREARM SIGHT

(75) Inventors: James Florence, Dallas, TX (US); Clay E. Towery, Plano, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/021,752

(22) Filed: Dec. 23, 2004

(51) Int. Cl.
*F41G 1/38* (2006.01)

(52) U.S. Cl. ..... 42/123; 42/111

(58) Field of Classification Search ..... 42/111–148; 89/41.06

See application file for complete search history.

(56) References Cited

U.S. PATENT DOCUMENTS

| | | | |
|---|---|---|---|
| 3,545,356 | A | 12/1970 | Nielsen |
| 3,785,261 | A | 1/1974 | Ganteaume |
| 3,911,451 | A | 10/1975 | Vockenhuber |
| 3,936,822 | A | 2/1976 | Hirschberg |
| 4,219,263 | A | 8/1980 | West |
| 4,290,219 | A | 9/1981 | Boller et al. |
| 4,309,095 | A | 1/1982 | Buckley |
| 4,452,458 | A | 6/1984 | Timander et al. |
| 4,541,191 | A | 9/1985 | Morris et al. |
| 4,553,943 | A | 11/1985 | Ahola |
| 4,630,911 | A | 12/1986 | Paul |
| 4,835,621 | A | 5/1989 | Black |
| 4,907,022 | A | 3/1990 | Myers |
| 4,936,190 | A | 6/1990 | Pilcher, II |
| 4,970,589 | A | 11/1990 | Hanson et al. |
| 4,989,024 | A | 1/1991 | Myers |
| 5,020,262 | A | 6/1991 | Pena |
| 5,026,158 | A | 6/1991 | Golubic |
| 5,285,273 | A | 2/1994 | James et al. |
| 5,287,644 | A | 2/1994 | Bolduc |
| 5,347,740 | A | 9/1994 | Rather et al. |
| 5,366,229 | A | 11/1994 | Suzuki |
| 5,406,730 | A | 4/1995 | Sayre |
| 5,425,299 | A | 6/1995 | Teetzel |
| 5,442,483 | A | 8/1995 | Monari |
| 5,455,868 | A | 10/1995 | Sergent et al. |
| 5,459,696 | A | 10/1995 | Dovrat et al. |
| 5,483,362 | A | 1/1996 | Tai et al. |
| 5,491,919 | A | 2/1996 | Rather et al. |
| 5,544,129 | A | 8/1996 | McNelis |
| 5,589,903 | A | 12/1996 | Speggiorin |
| 5,686,690 | A | 11/1997 | Lougheed et al. |
| 5,826,360 | A | 10/1998 | Herold et al. |

(Continued)

FOREIGN PATENT DOCUMENTS

| | | |
|---|---|---|
| EP | 0 985 899 | 3/2000 |

(Continued)

OTHER PUBLICATIONS

U.S. Appl. No. 11/021,748, filed Dec. 23, 2004 by inventors James M. Florence and Clay E. Towery for "Method and Apparatus for Safe Operation of an Electronic Firearm Sight Depending Upon Detected Ambient Illumination", 35 pages of text, 5 pages of drawings.

(Continued)

*Primary Examiner*—Michael J. Carone
*Assistant Examiner*—Gabriel J. Klein
(74) *Attorney, Agent, or Firm*—William C. Schubert; Karl A. Vick

(57) ABSTRACT

A weapon sight can be mounted on a weapon. According to one aspect of the invention, the sight only presents certain information on a display if the orientation of the sight satisfies an orientation criteria.

10 Claims, 5 Drawing Sheets

U.S. PATENT DOCUMENTS

| | | | | |
|---|---|---|---|---|
| 5,917,775 | A | 6/1999 | Salisbury | |
| 5,973,998 | A | 10/1999 | Showen et al. | |
| 5,991,043 | A | 11/1999 | Andersson et al. | |
| 6,000,163 | A * | 12/1999 | Gordon | 42/119 |
| 6,363,223 | B1 | 3/2002 | Gordon | |
| 6,373,628 | B1 | 4/2002 | Gunnarsson et al. | |
| 6,425,697 | B1 | 7/2002 | Potts et al. | |
| 6,539,661 | B1 | 4/2003 | Hope | |
| 6,580,876 | B1 | 6/2003 | Gordon | |
| 6,678,395 | B1 | 1/2004 | Yonover et al. | |
| 6,967,775 | B1 | 11/2005 | Millett | |
| 6,988,331 | B1 * | 1/2006 | Holmberg | 42/142 |
| 2005/0018041 | A1 | 1/2005 | Towery et al. | |
| 2005/0268521 | A1 | 12/2005 | Cox et al. | |

FOREIGN PATENT DOCUMENTS

| | | |
|---|---|---|
| WO | WO 85/03118 | 7/1985 |
| WO | WO 02/46822 | 6/2002 |

OTHER PUBLICATIONS

U.S. Appl. No. 11/021,749, filed Dec. 23, 2004 by inventors James M. Florence and Clay E. Towery for "Method and Apparatus for Safe Operation of an Electronic Firearm Sight Depending Upon the Detection of a Selected Color", 36 pages of text, 5 pages of drawings.

* cited by examiner

METHOD AND APPARATUS FOR SAFE OPERATION OF AN ELECTRONIC FIREARM SIGHT

TECHNICAL FIELD OF THE INVENTION

This invention relates in general to a device that facilitates accurate aiming of a firearm and, more particularly, to a firearm sight that is mounted on the firearm, and through which a user observes a potential target.

BACKGROUND OF THE INVENTION

Over the years, various techniques and devices have been developed to help a person accurately aim a firearm, such as a rifle or a target pistol. One common approach is to mount a sight or scope on the firearm's barrel. A person then uses the sight or scope to view an intended target in association with a reticle, often with a degree of magnification. Although existing firearm sights of this type have been generally adequate for their intended purposes, they have not been satisfactory in all respects.

For example, some pre-existing sights have included the capability to record an image showing a target and/or a reticle, and to later display one or more of these recorded images. However, when these recorded images are displayed, it is possible for a safety hazard to occur. For example, if the recorded image is presented on an electronic display that is separately used to show actual targets, a user may mistake the recorded image for an actual target, and may then discharge the weapon in the belief that he or she is shooting at something in the recorded image, when the weapon is actually pointed at some other person or thing. Moreover, even if the user does not intentionally discharge the weapon while viewing recorded images, there is always a risk of accidental discharge. Consequently, if the user is distracted while viewing recorded images, or gives the weapon and sight to another person who is distracted or who is not familiar with weapon safety, the weapon may be inadvertently pointed in a direction that presents a safety hazard.

A different consideration is that hunting regulations in most states stipulate that hunting is allowed only during the time from one-half hour before sunrise to one-half hour after sunset. The intent of these regulations is to prevent the unsafe practice of shooting in very low light levels, where the actual identity of a target may be questionable. The level of illumination at one-half hour before sunrise and at one-half hour after sunset is sometimes referred to as "civil twilight", and falls in a luminance range of 0.1 to 1.0 foot-candles. This luminance range corresponds to a cloudless sky. Other conditions can cause the illumination level to drop below that of civil twilight at almost any time during the day, for example where there is a dense cloud cover, or where a hunter is in a dense forest. There is no easy way for hunters and game wardens to determine actual levels of illumination, and this is why states have adopted the compromise approach of defining allowable hunting conditions in terms of dusk and dawn, rather than in terms of actual levels of illumination. Existing sights provide hunters with no assistance in detecting or avoiding actual low light conditions that can present potential safety hazards.

Still another consideration is that virtually all states have a hunting regulation that requires hunters to wear a fluorescent orange garment above the waist while hunting. This color does not occur naturally in any big game animals, or in their environment. The fluorescent orange color is thus intended to be a visual cue to a hunter that a person is present, rather than a potential animal target. Even where such a garment is present, the patch of orange color may be partly obscured by other objects in the scene, or may be very small if the hunter is a significant distance from the person wearing the garment. In either case, the presence of the orange color in the scene may be inadvertently and unintentionally overlooked by a hunter, resulting in a potentially dangerous situation for the person wearing the garment. Existing rifle sights provide hunters with no assistance in detecting fluorescent orange to avoid potentially dangerous hunting situations.

SUMMARY OF THE INVENTION

According to one aspect of the invention, a method and apparatus relate to a weapon-mountable sight having a display and involve presenting selected information on the display only when a detector portion indicates that the sight has an orientation that meets an orientation criteria.

According to a different aspect of the invention, a method and apparatus relate to a weapon-mountable sight and involve: using a detector portion to determine a level of ambient illumination external to the sight; and taking a selected action in response to a determination that the level of ambient illumination is less than a selected level of illumination.

According to still another aspect of the invention, a method and apparatus relate to a weapon-mountable sight, and involve taking a selected action in response to detection of a selected color within radiation originating from externally of the sight.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
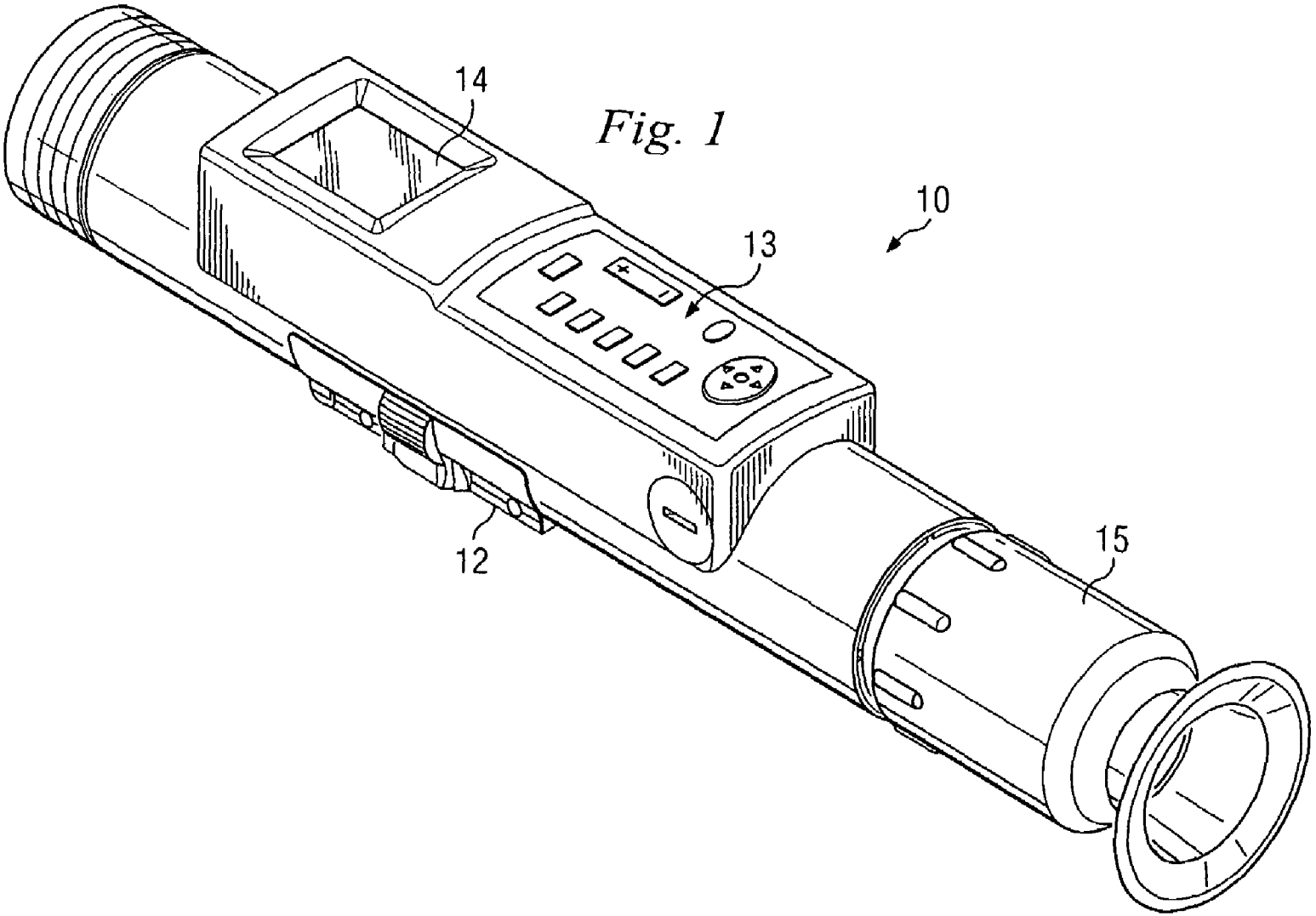
FIG. 1 is a diagrammatic perspective view of an apparatus that is a digital rifle sight embodying aspects of the present invention.

FIG. 1 is a diagrammatic perspective view of an apparatus that is a digital rifle sight 10, and that embodies aspects of the present invention. Although the sight 10 is sometimes referred to herein as a "rifle" sight, it can actually be used not only with rifles, but also with other types of firearms, such as target pistols.

The sight 10 includes a rail support or rail mount 12 that can fixedly and securely support or mount the sight 10 on the barrel of a firearm. The sight 10 has a switch panel 13, with several manually operable switches that are discussed in more detail later. The sight 10 has an external color display 14 that, in the disclosed embodiment, is a liquid crystal display (LCD) of a type commonly found on digital cameras and video cameras for the purpose of viewing images or video clips that have been stored within these cameras. One end of the sight 10 has an eyepiece section 15.

Figure 2:
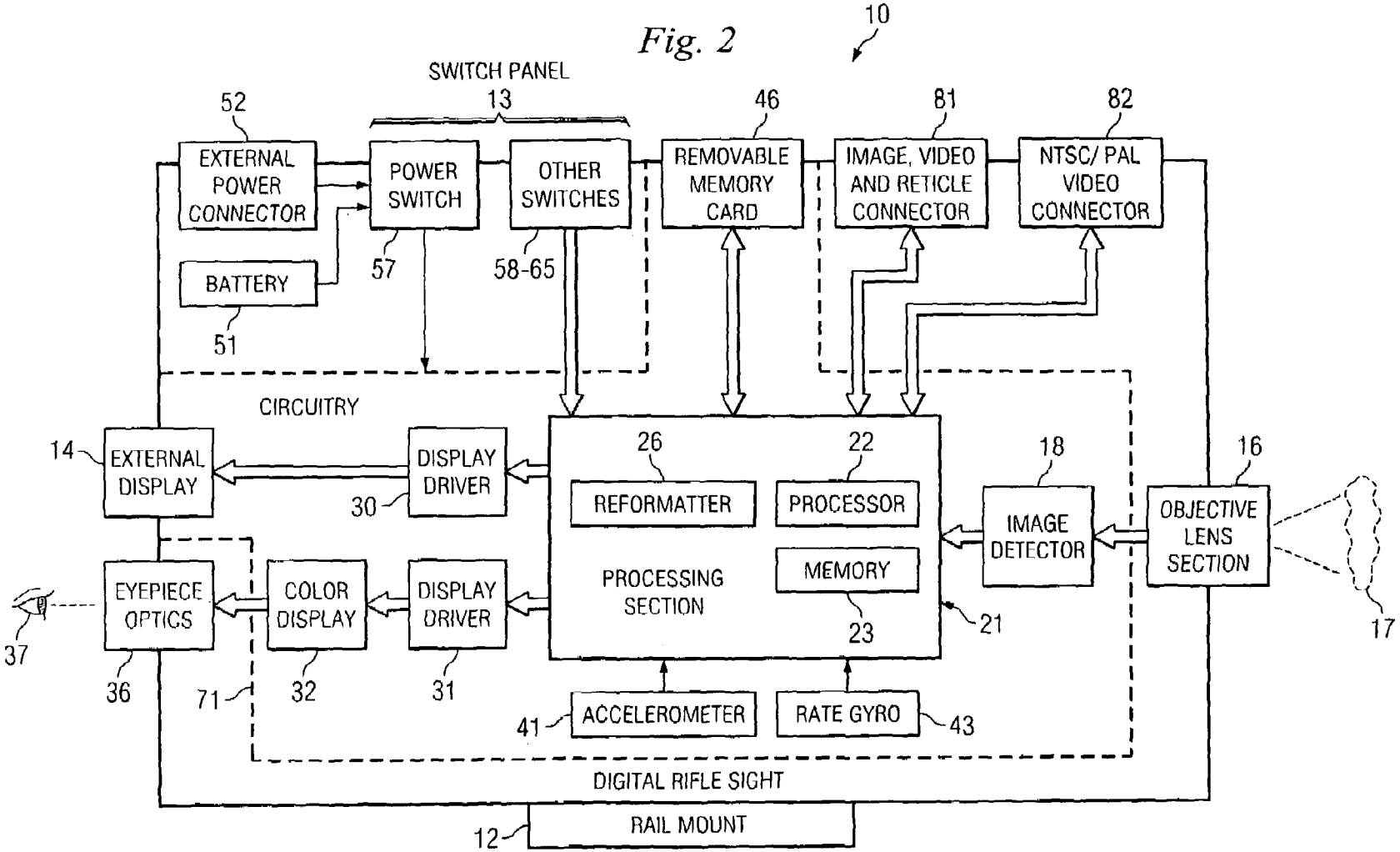
FIG. 2 is a block diagram of the digital rifle sight of FIG. 1, and shows some internal components thereof.

FIG. 2 is a block diagram of the rifle sight 10, and shows some internal components of the sight 10 that are relevant to an understanding of the present invention.

The sight 10 includes an objective lens section 16 of a known type. In the disclosed embodiment, the lens section 16 has a field of view (FOV) of 5°, but it could alternatively have some other field of view. The lens section 16 optically images a remote scene or target 17 onto an image detector 18. In the disclosed embodiment, the image detector 18 is a charge coupled device array (CCD array) of a known type, and has 1,920,000 detector elements that each correspond to a respective pixel in each image produced by the image detector 18, and that are arranged as an array of 1600 detector elements by 1200 detector elements. However, the image detector 18 could alternatively be implemented with any other suitable device, including a device having a larger or smaller number of detector elements, or a type of device other than a CCD array, such as a Complementary Metal Oxide Semiconductor (CMOS) image sensor.

The image detector 18 produces a sequence of digital color images of the scene 17, and this sequence of images is supplied to a control section or processing section 21. Although the image detector 18 of the disclosed embodiment produces color images, the images could alternatively be monochrome images, or black and white images. The processing section 21 includes a processor 22 of a known type, and a memory 23. The memory 23 in FIG. 2 is a diagrammatic representation of the memory provided for the processor 22, and may include more than one type of memory. For example, the memory 23 may include a read only memory (ROM) that contains a program executed by the processor 22, as well as data that does not change during program execution. The memory 23 can also include some semiconductor memory of the type commonly known as "flash" RAM. A "flash" RAM is a type of memory that is commonly used in devices such as memory cards for digital cameras, and that maintains the information stored therein even when electrical power is turned off.

The processing section 21 further includes a reformatter 26 of a known type. The reformatter 26 is capable of taking an image generated by the image detector 18, and reformatting the image to a lower resolution that is suitable for presentation on a display having a lower resolution than the image detector 18. Images processed by the reformatter 26 are selectively supplied to two display driver circuit 30 and 31. The display driver circuit 30 drives the external display 14, and the display driver circuit 31 drives an internal color display 32. The display driver circuits 30 and 31 can be different channels of a single display driver circuit, but are shown as separate blocks in FIG. 2 for clarity. In the disclosed embodiment, the color display 32 is a liquid crystal display (LCD) of a known type, and has 76,800 pixel elements arranged as an array of 320 elements by 240 elements. The display 32 could, however, have a larger or smaller number of pixel elements, or could be any other suitable type of display, such as an organic light emitting diode (OLED) display, a liquid crystal on silicon (LCOS) display, or a micro-electro-mechanical system (MEMS) reflective display.

The eyepiece section 15 (FIG. 1) of the sight 10 includes eyepiece optics 36 of a known type. The eyepiece optics 36 permit the internal display 32 to be comfortably viewed by an eye 37 of a person who is using the sight 10 in association with a firearm. In the disclosed embodiment, the eyepiece optics 36 have an FOV of 15°, but could alternatively have some other suitable FOV. In addition, the eyepiece optics 36 of the disclosed embodiment could optionally be omitted for applications that allow a person to directly view the display 32 with a viewing distance greater than about 8 inches, since comfortable viewing is then possible with little eye accommodation needed.

The sight 10 includes an accelerometer 41 that has an output coupled to the processing section 21. In the disclosed embodiment, the accelerometer 41 is a device that can be obtained commercially as part number ADXL105 from Analog Devices, Inc. of Norwood, Mass. Although the disclosed embodiment implements the accelerometer 41 with the Analog Devices ADXL105 device, the accelerometer 41 could alternatively be implemented with any other suitable device. The accelerometer 41 is a micro-electro-mechanical system (MEMS) device, and serves as a highly sensitive sensor that can detect the relatively small shock wave caused when a firing pin strikes a cartridge within a firearm on which the sight 10 is mounted. In addition, as discussed later, the accelerometer 41 is also responsive to the force of gravity.

When a firing pin strikes a cartridge, it triggers combustion of the gunpowder or other propellant within the cartridge, so as to expel a bullet or other projectile from the cartridge and firearm. Consequently, a relatively small shock wave is produced when the firing pin strikes the cartridge, and this small shock wave is promptly followed by a significantly larger shock wave or recoil that is produced by the combustion of the gunpowder and the expulsion of the bullet. The latter shock wave is several orders of magnitude larger than the shock wave produced when the firing pin strikes the cartridge. The accelerometer 41 has the sensitivity and bandwidth needed to detect the relatively small shock wave produced when the firing pin strikes the cartridge, but also has the durability needed to withstand the much larger shock wave produced by the ensuing combustion within the cartridge.

The output signal from the accelerometer 41 has a frequency spectrum for the small shock wave that is significantly different from the frequency spectrum for the ensuing large shock wave. Consequently, the processing section 21 can distinguish a shock wave that represents the firing pin striking a cartridge from a shock wave that represents some other type of event, such as combustion within a cartridge. For example, in order to identify the small shock wave, the processing section 21 could apply a fast Fourier transform (FFT) to the output of the accelerometer 41, filter out frequency components that are outside a frequency band of approximately 5 KHz to 10 KHz, and then look for a pulse in the energy between 5 KHz and 10 KHz.

The sight 10 includes a gyroscope 43, with an output that is coupled to the processing section 21. The gyroscope is referred to herein as a rate gyro. In the disclosed embodiment, the rate gyro 43 is implemented with a MEMS device that is available commercially as part number ADXRS150 from Analog Devices, Inc. Although the disclosed embodiment uses the Analog Devices ADXRS150 device, it would alternatively be possible to implement the rate gyro 43 with any other suitable device.

The rate gyro 43 is capable of detecting angular movement of the sight 10 about a not-illustrated vertical axis that is spaced from the rate gyro 43. Thus, the rate gyro 43 is a highly sensitive device that is effectively capable of detecting movement of the sight 10 in directions transverse to a not-illustrated center line of the objective lens section 16.

The sight 10 includes a removable memory card 46 that, when present within the sight 10, is operatively coupled to the processing section 21. In the disclosed embodiment, the memory card 46 is a memory card of the type commonly used in digital cameras. However, it would alternatively be possible to use any other suitable device for the removable memory card 46.

The sight 10 includes a battery 51 that, in the disclosed embodiment, is a replaceable battery of a known type. However, the battery 51 could alternatively be a rechargeable battery. The sight 10 also includes an external power connector 52 that can be coupled to an external source of power, such as a converter that converts alternating current (AC) to direct current (DC).

As mentioned above in association with FIG. 1, the sight 10 has a switch panel 13 with a plurality of manually operable switches. These switches include a power switch 57, and also include several other switches 58–65 that are each coupled to the processing section 21, and that are discussed in more detail below. The battery 51 and the external power connector 52 are each coupled to inputs of the power switch 57. When the power switch 57 is respectively actuated and deactuated, it respectively permits and interrupts a flow of current from the battery 51 and/or the connector 52 to circuitry 71 that is disposed within the sight 10, and that requires electrical power in order to operate. The circuitry 71 includes the image detector 18, the processing section 21, the display drivers 30 and 31, the external display 14, the internal display 32, the accelerometer 41, the rate gyro 43, and the memory card 46.

The sight 10 has a connector 81 that is coupled to the processing section 21. The connector 81 can be used to upload image data or video data from the sight 10 to a not-illustrated computer, as discussed later. In addition, the connector 81 can be used to download an electronic reticle from a computer to the sight 10, as also discussed later. In the disclosed embodiment, the physical configuration of the connector 81, as well the protocol for transferring information through it, conform to an industry standard that is commonly known as the Universal Serial Bus (USB) standard. However, it would alternatively be possible to use any other suitable type of connector and communication protocol, such as a standard serial connector and communication protocol, or a standard parallel connector and communication protocol.

The sight 10 includes a further connector 82, through which video information can be transferred from the sight 10 to an external device, in a manner conforming to an industry video standard that is commonly known as the National Television Standards Committee/Phase Alternating Line (NTSC/PAL) standard. In the disclosed embodiment, the connector 82 is a standard component of the type commonly known as an RCA jack. However, it could alternatively be any other suitable type of connector, and information could be transferred through it according to any other suitable protocol.

Figure 3:
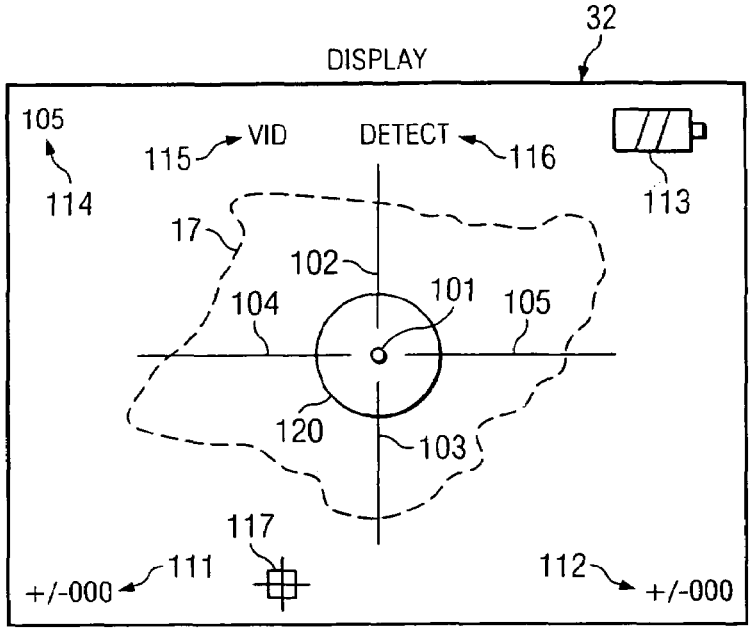
FIG. 3 is a diagrammatic view of an internal display that is a component of the rifle sight of FIG. 1, as seen by the eye of a person using the sight.

FIG. 3 is a diagrammatic view of the internal display 32, as seen by the eye 37 of a person looking into the sight 10 through the eyepiece optics 36. In a normal operational mode, the display 32 presents a view of the scene 17, as captured by the image detector 18 through the objective lens section 16. The scene 17 is shown diagrammatically in FIG. 2 by broken lines.

The processing section 21 superimposes a reticle 101–105 on the image of the scene 17. In the disclosed embodiment, the reticle includes a small center circle 101, and four lines 102–105 that each extend radially with respect to the circle 101, and that are offset by intervals of 90°. The reticle 101–105 is a digital image that is downloaded into the sight 10 through the USB connector 81, and that is stored by the processing section 21 in a non-volatile portion of the memory 23. The reticle can have almost any configuration desired by a user. In particular, a reticle with virtually any desired configuration can be created by a user in a separate computer, or obtained by the user from the sight manufacturer or a third party through a network such as the Internet. The new reticle can then be downloaded electronically in digital form through the connector 81, and is stored in the memory 23 of the processing section 21.

The processing section 21 takes the reticle that is currently stored in the memory 23, and digitally superimposes the reticle on images that will be sent to the display 32. In FIG. 3, the reticle 101–105 has been superimposed on the image in a manner so that the reticle is centered on the display 32. However, the position where the reticle appears on the display 32, and thus the position of the reticle relative to the image of the scene 17, can be adjusted in a manner that is described later.

The processing section 21 can also superimpose some additional information on the image of the scene 17. In this regard, the lower left corner of the display 32 includes a windage or azimuth adjustment value 111. As mentioned earlier, the position of the reticle 101–105 on the display 32 can be adjusted, in a manner that is discussed in more detail later. The windage adjustment value 111 is a positive or negative number that indicates the offset by which the reticle 101–105 has been adjusted either leftwardly or rightwardly from the centered position shown in FIG. 3.

The upper right corner of the display 32 has a battery charge indicator 113 that is divided into three segments, and that is used to indicate the state of the battery 51. In particular, when the battery is fully charged, all three segments of the battery charge indicator 113 are displayed. Then, as the battery 51 becomes progressively discharged, there will be a progressive decrease in the number of displayed segments of the battery charge indicator 113.

The upper left corner of the display 14 presents an image count value 114, and this count value 114 relates to the fact that the processing section 21 can store images in the removable memory card 46, as discussed later. The image count value 114 is an indication of how many additional images can be stored in the unused space that remains within the memory card 46.

The top center portion of the display 32 has a capture mode indicator 115, and a firing pin detection indicator 116. The capture mode indicator 115 shows which of two capture modes is currently in effect, as discussed later. The firing pin detection indicator 116 indicates whether or not the sight is currently enabled to detect the firing pin striking a cartridge, as discussed later.

The bottom central portion of the display 32 includes an autoboresight alignment indicator 117, for a purpose that is not related to the present invention, and that is therefore not described here in detail. An angular error indicator 120 appears in the central portion of the display 32. The indicator 120 is a circle that is larger than and concentric to the circle 101 at the center of the reticle 101–105. The diameter of the indicator 120 is increased and decreased in response to variation of a particular operational criteria, as discussed later. Depending on the current mode of operation of the sight 10, the reticle 101–105 and the various indicators 111–120 may all be visible, or only some may be visible.

Figure 4:
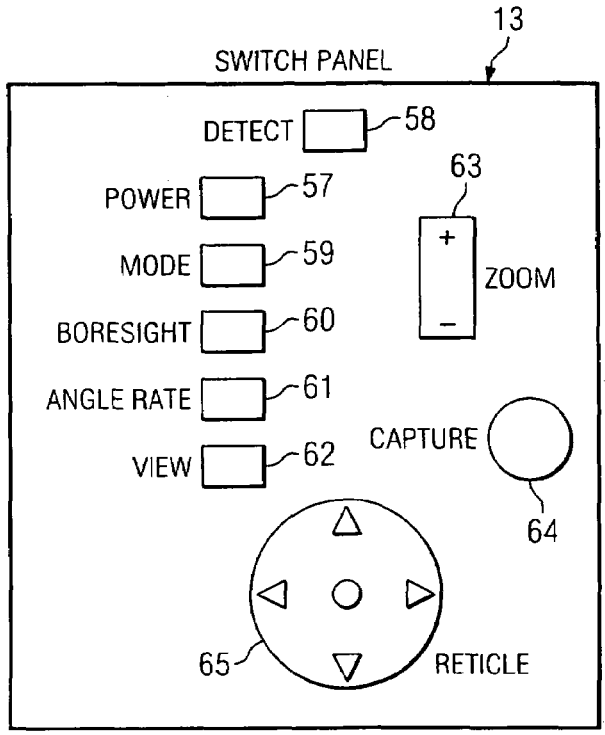
FIG. 4 is a diagrammatic view of a switch panel that is a component of the rifle sight of FIG. 1, and that has a plurality of manually operable switches.

FIG. 4 is a diagrammatic view of the switch panel 13, and shows each of the manually operable switches 57–65 of the switch panel 13. The types of switches and their arrangement on the panel 13 is exemplary, and it would alternatively be possible to use other types of switches, and/or to arrange the switches in a different configuration. The power switch 57 has already been discussed above, and therefore is not discussed again here.

The switch 58 is a detect switch. As mentioned earlier, the accelerometer 41 (FIG. 2) is capable of detecting a shock wave that occurs when the firing pin of the firearm strikes a cartridge. Successive manual actuations of the detect switch 58 alternately instruct the processing section 21 to enable and disable this detection feature. When this feature is respectively enabled and disabled, the detection indicator 116 is respectively visible on and omitted from the display 32.

The switch 59 is a mode switch. In one operational mode, the processing section 21 of the sight 10 can take a single image generated by the image detector 18, and store this image in the removable memory card 46. In a different operational mode, the processing section 21 can take several successive images generated by the image detector 18, which collectively form a video clip, and store these images in the memory card 46. Successive actuations of the mode switch 59 cause the processing section 21 to toggle between these two operational modes. When the mode for storing video clips is respectively enabled and disabled, the detection indicator 115 is respectively visible on and omitted from the display 32. There are two types of events that will cause the processing section 21 to save an image or a video clip.

First, if the detect switch 58 has been used to enable detection of the firing pin striking a cartridge, the processing section 21 will respond to each detection of this event by saving either a single image or a video clip in the memory card 46, depending on whether the capture mode that has been selected using the mode switch 59 is the image capture mode or the video capture mode. It will be recognized that, since a video clip is a series of several images, saving a video clip in the memory card 46 will take up several times the storage space that would be required to save a single image. After saving an image or a video clip, the processing section 21 adjusts the image count indicator 114 presented on the display 32. In particular, if a single image is stored, then the count value 114 will simply be decremented. On the other hand, if a video clip is saved, the value of the indicator 114 will be reduced by an amount that corresponds to the number of images in the video clip.

The other event that will cause the processing section 21 to save one image or a video clip is manual operation of the switch 64, which is a capture switch. Whether the processing section 21 saves a single image or a video clip is dependent on the capture mode that has been selected using the mode switch 59. When the capture switch 64 is manually operated, the processing section 21 selects either a single image or a video clip from the current output of the image detector 18, and then saves this image or video clip in the memory card 46. As mentioned earlier, a separate and not-illustrated computer can be coupled to the connector 81, and the processing section 21 can upload to that computer the images or video clips that are stored in the memory card 46.

The switch 63 is a rocker switch that serves as a zoom control switch. Pressing one end of the switch 63 increases the zoom factor, and pressing the other end decreases the zoom factor. In the disclosed embodiment, the zoom is continuous and can range from 1× to 4×. When the disclosed system is operating at a zoom factor of 4×, a center portion is extracted from each image produced by the image detector 18, where the center portion has a size of 320 by 240 pixels. This center portion is then displayed on the color display 32, with each pixel from the center portion being mapped directly on a one-to-one basis to a respective pixel of the display 32.

When the zoom factor is at 1×, the reformatter 26 essentially takes an entire image from the image detector 18, divides the pixels of that image into mutually exclusive groups that each have 16 pixels arranged in a 4 by 4 format, averages or interpolates the 16 pixels of each group into a single calculated pixel, and then maps each of the calculated pixels to a respective corresponding pixel of the display 32. Similarly, when the zoom factor is at 3×, the reformatter 26 essentially takes an image from the image detector 18, extracts a center portion having a size of about 960 pixels by 720 pixels, divides the pixels of this center portion into mutually exclusive groups that each have 9 pixels arranged in a 3 by 3 format, averages or interpolates the 9 pixels of each group into a single calculated pixel, and then maps each of the calculated pixels to a respective corresponding pixel of the display 32. As still another example, when the zoom factor is at 2×, the reformatter 26 essentially takes an image from the image detector 18, extracts a center portion having a size of about 640 pixels by 480 pixels, divides the pixels of this center portion into mutually exclusive groups that each have 4 pixels arranged in a 2 by 2 format, averages or interpolates the 4 pixels of each group into a single calculated pixel, and then maps each of the calculated pixels to a respective corresponding pixel of the display 32.

As mentioned above, the zoom from 1× to 4× is continuous in the disclosed embodiment. When the zoom factor is between 1× and 2×, between 2× and 3×, or between 3× and 4×, the reformatter 26 takes an appropriate portion of an image, and then groups, interpolates and maps the pixels of this portion into the pixels of the display 32, in a manner analogous to that discussed above. Although the zoom in the disclosed embodiment is continuous, it would alternatively be possible for the zoom factor to be moved between discrete zoom levels, such as the four discrete zoom levels of 1×, 2×, 3× and 4×. In addition, although the zoom range in the disclosed embodiment is 1× to 4×, it would alternatively be possible to use some other zoom range.

With reference to FIG. 4, the switch 65 is a four-way reticle switch. Any one of the upper, lower, left or right sides of this switch (as viewed in FIG. 4) can be manually operated in order to respectively indicate a selection of up, down, left or right. Each time the upper side of the switch 65 is actuated, the position of the reticle 101–105 is adjusted upwardly with respect to the display 32, and thus with respect to the image of the scene 17 that is presented on the display 32. Each such actuation of the switch 65 causes the reticle 101–105 to be moved upwardly by a predetermined number of pixels, and the elevation value 112 in the lower right corner of the display 32 is incremented in response to each such adjustment. Similarly, if the lower side of the switch 65 is actuated, the reticle 101–105 is adjusted downwardly on the display 32 by the predetermined number of pixels, and the elevation value 112 is decremented. Similarly, actuation of the left or right side of the switch 65 causes the reticle 101–105 to be adjusted leftwardly or rightwardly by a predetermined number of pixels on the display 32, and causes the windage value 111 in the lower left corner of the display 32 to be either incremented or decremented.

Figure 5:
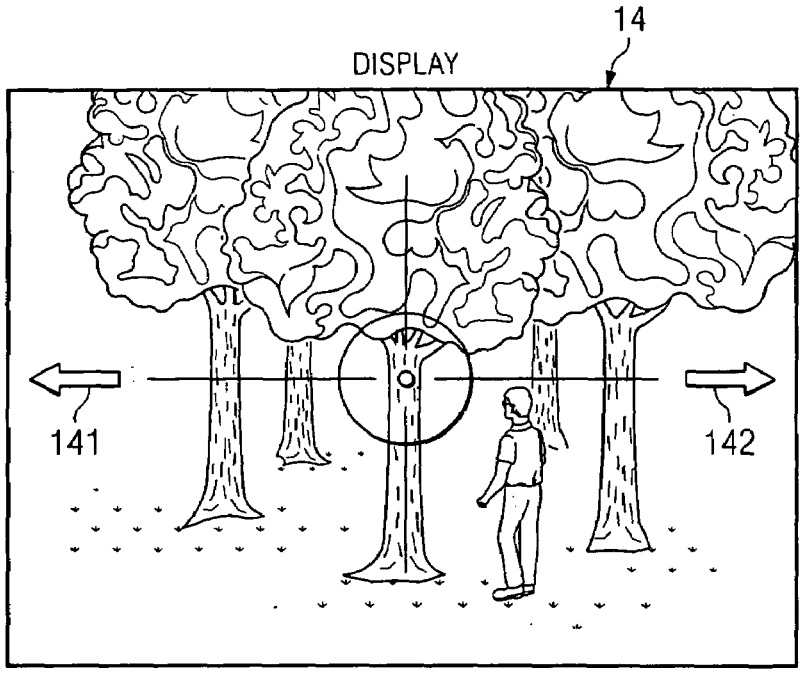
FIG. 5 is a diagrammatic view of an external display that is a component of the rifle sight of FIG. 1, with a recorded image displayed thereon.

As mentioned above, the sight 10 is capable of capturing and storing either single images or short video clips. In order to view these stored images or clips, the user presses the view switch 62, thereby causing the processing section 21 to use the external display 14 to present either the first still image from the memory card 46, or the first video clip from the memory card 46. FIG. 5 is a diagrammatic view of the display 14 with a recorded image displayed thereon. It will be noted that the recorded image includes not only the scene, but also the reticle 101–105, so that the user can see where the reticle was positioned with respect to the scene when the trigger of the rifle was pulled.

If the memory card 46 contains more than one image or video clip, then an arrow 142 will be visible to indicate that the user can move forward through the images or video clips. The user presses the right side of the reticle switch 65 in order to move to the next successive image or video clip. Except when the user is viewing the first image or video clip, an arrow 141 will be visible to indicate that the user can move backward through the images or video clips. The user presses the left side of the reticle switch 65 in order to move backward through the images or video clips. The view indicator 142 will be visible except when the user is viewing the last image or video clip, and the view indicator 141 will be visible except when the user is viewing the first image or video clip. The view mode is terminated by pressing the switch 62 a second time, in order to turn off the external display 14 and thereby conserve battery power.

As is well known to persons who use rifles and similar weapons, care must always be used to avoid pointing the rifle at anyone or anything that the user does not intend to shoot, in case there is an accidental discharge of the rifle. The sight 10 is designed to reduce the likelihood that the rifle may be inadvertently pointed in a direction that presents a safety hazard. In particular, the sight 10 includes the external display 14, in order to avoid displaying any recorded images from the memory on the internal display 32. This avoids a situation in which a hunter might mistake a recorded image on the internal display 32 for an actual view of the target, and then discharge the firearm in the belief that he or she was shooting at something in the recorded image, when in fact the rifle was actually aimed at something or someone else.

A further consideration is that, even with the presence of the external display 14, there could still be a potential safety hazard if a user became distracted while viewing recorded images on the display 14, and inadvertently pointed the rifle in a direction that presented a safety hazard. A similar scenario is that the user might inadvertently point the rifle in an unsafe direction while trying to orient the sight 10 so that another person can see the images on the display 14. Or the user might hand the rifle with the sight 10 to that other person, in order to allow the person to have a good view of images presented on the external display 14. That other person might then point the rifle in an unsafe manner, either because the person was distracted by the displayed images, and/or because the person simply was not suitably familiar with the basic principles of safe weapon handling.

The sight 10 is designed to also avoid this latter type of hazard. More specifically, as mentioned above, the accelerometer 41 is very sensitive and can detect the force of gravity. Consequently, as the sight 10 is progressively moved from a position where the rifle barrel is horizontal to a position where the rifle barrel is pointing vertically upwardly, the output signal of the accelerometer 41 will have a force component due to gravity that progressively increases. Based on that force component, the processor 22 in the control section 21 of the sight 10 does not present any images on the external display 14, unless an optical centerline of the sight 10 (which extends generally parallel to the barrel of the attached rifle) is within 10° to 20° of a vertical reference. Consequently, the rifle barrel will be pointing almost directly upwardly wherever the external display 14 is actuated and showing any recorded image information.

Although the sight 10 uses the accelerometer 41 to determine its orientation, it would alternatively be possible to use any other suitable sensor arrangement to detect orientation. As one example, it would be possible to use a group of conventional mercury switches having different orientations.

The switch 61 serves as an angle rate switch that can be operated to enable and disable the display of an angular error rate, as sensed by the rate gyro 43. In particular, successive manual actuations of the switch 61 will alternately enable and disable this function. When this function is respectively enabled and disabled, the angular error indicator 120 is respectively visible on and omitted from the display 32. When this function is enabled, the processing section 21 monitors the output of the rate gyro 43. Typically, a user will be aiming the firearm and attempting to keep the reticle center 101 accurately centered on a portion of the scene 17 that is considered to be a target.

If the user happens to be holding the firearm very steady, then the rate gyro 43 will detect little or no angular motion of the sight 10 and the firearm, or in other words little or no transverse movement thereof. Consequently, the processing section 21 will present the indicator 120 as a circle of relatively small diameter, in order to indicate to the user that the firearm is being relatively accurately held on the selected target. On the other hand, if the user is having difficulty holding the firearm steady, then the rate gyro 43 will detect the greater degree of angular movement of the firearm and the sight 10. Consequently, the processing section 21 will display the indicator 120 with a larger diameter, thereby indicating that the reticle center 101 is not being held on the target as accurately as would be desirable.

In the disclosed embodiment, the change in the diameter of the indicator 120 is continuous. In other words, a progressive increase in the amount of angular movement of the firearm and the sight 10 results in a progressive increase in the diameter of the indicator 120. Conversely, a progressive decrease in the amount of angular movement of the firearm and sight results in a progressive decrease in the diameter of the indicator 120. The user will therefore endeavor to squeeze the trigger of the firearm at a point in time when the reticle center 101 is centered on the target, and when the indicator 120 has a relatively small diameter that indicates the firearm is currently being held very steady.

The remaining switch 60 on the switch panel 55 is a boresight switch, and is used to enable and disable an autoboresight alignment mode. When this mode is respectively enabled and disabled, the autoboresight alignment indicator 117 is respectively visible on and omitted from the dismay 32. As indicated earlier, the autoboresight alignment function is not related to the present invention, and therefore is not described here in detail.

Hunting regulations in most states stipulate that hunting is allowed during the time from one-half hour before sunrise to one-half hour after sunset. The intent of these regulations is to prevent the unsafe practice of shooting in very low light levels, where the actual identity of a target may be questionable. The level of illumination at one-half hour before sunrise and at one-half hour after sunset is sometimes referred to as "civil twilight", and falls in a luminance range of 0.1 to 1.0 foot-candles. This luminance range corresponds to a cloudless sky. Other conditions can reduce ambient illumination to a level below that of civil twilight at almost any time during the day, for example where there is a dense cloud cover, or where a hunter is in a dense forest. There is no easy way for hunters and game wardens to determine actual levels of illumination, and this is why states have adopted the compromise approach of defining allowable hunting conditions in terms of dusk and dawn, rather than in terms of actual levels of illumination.

The image detector 18, based on its sensitivity and integration time, can give a direct measure of the actual levels of illumination present in scenes viewed through the sight 10. Consequently, the processing section 21 analyzes the images received from the image detector 18, in order to determine the ambient level of illumination within the detected scene. In the disclosed embodiment, the processing section 21 averages the brightness of all of the pixels in a given image, and then compares the calculated average to a predetermined threshold that corresponds to civil twilight. Alternatively, however, any other suitable technique may be used to make this analysis. If the processing section 21 determines that the calculated average brightness is above the predetermined threshold, indicating that the level of ambient illumination is greater than civil twilight, then the sight 10 is operated in a normal manner. On the other hand, if the processing section 21 determines that the calculated average brightness is below the threshold, then the processing section displays a warning.

Figure 6:
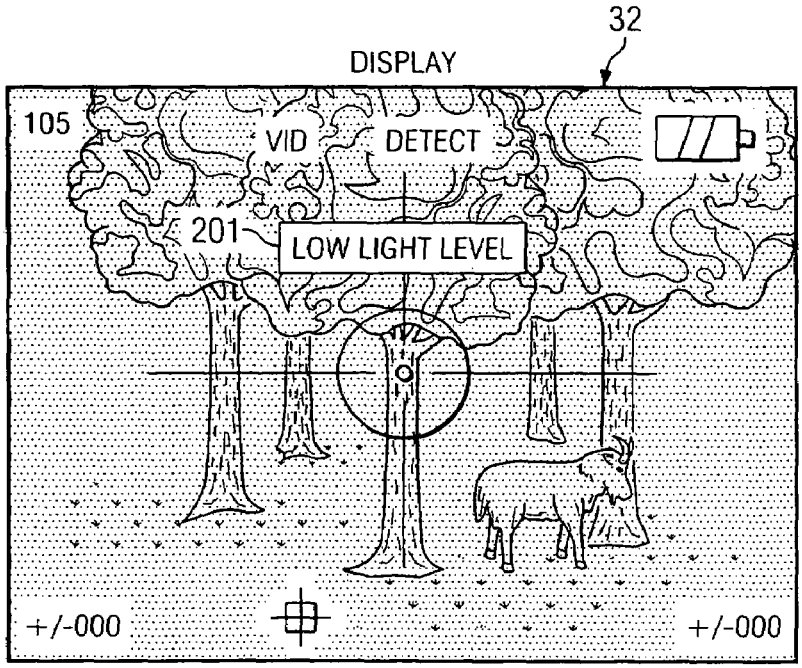
FIG. 6 is a diagrammatic view of the internal display while the rifle sight is being used to view a scene having a low level of ambient illumination.

More specifically, FIG. 6 is a diagrammatic view of the internal display 32 while the sight 10 is being used to view a scene having a low level of ambient illumination. After calculating the average level of brightness for the displayed image, and determining that the calculated average is below the predetermined threshold, the processing section 21 displays the image with the addition of a warning 201. In the disclosed embodiment, the warning 201 is the alphanumeric phrase "LOW LIGHT LEVEL". In order to attract the attention of the user, this warning can be displayed in a color such as red, and/or can be made to blink. This warning notifies the user that light levels are low, thereby reminding the user that target recognition may be questionable and that hunting conditions may be unsafe. A responsible hunter will not want to shoot in these conditions.

Although the warning 201 in the disclosed embodiment is the alphanumeric phrase "LOW LIGHT LEVEL", it could alternatively be some other alphanumeric phrase, a symbol such as a circle with a slash through it, or a combination of a symbol and an alphanumeric phrase. In addition, as discussed above, the disclosed embodiment responds to detected low light levels by displaying the warning 201 in association with the detected image. Alternatively, however, it would be possible for the processing section 21 to respond to the detection of a low light level by inhibiting the display of any image of any scene. In that case, the processing section could display the warning 201 (without any image), or could simply disable the presentation of any information on the display 32.

Virtually all states have a hunting regulation that requires hunters to wear a fluorescent orange garment above the waist while hunting. This color does not naturally occur in any big game animals or their environment, and is intended to be a visual cue to a hunter that a person is present, rather than a potential animal target. Even where such a garment is present, the patch of orange color may be partly obscured by other objects in the scene, or may be very small if the hunter is a significant distance from the person wearing the garment. In either case, the presence of the orange color in the scene may be inadvertently and unintentionally overlooked by a hunter, resulting in a potentially dangerous situation for the person wearing the garment.

Figure 7:
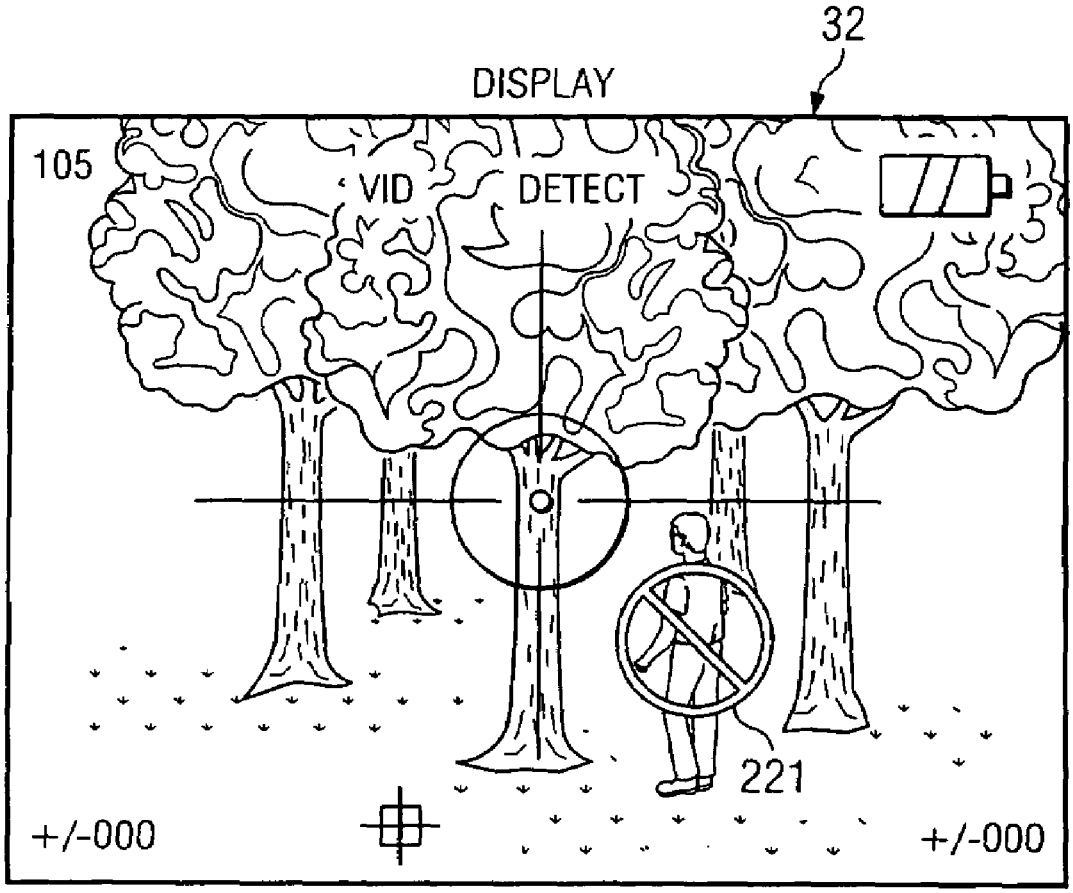
FIG. 7 is a diagrammatic view of the internal display while the rifle sight is being used to view a scene that includes a person wearing a fluorescent orange garment.

As a safety measure, the processing section of the sight 10 monitors images received from the image detector 18 for any pixels therein that represent a fluorescent orange color in the scene. If this color is detected, then the processing section 21 superimposes a warning on the image. In this regard, FIG. 7 is a diagrammatic view of the internal display 32 while the sight 10 is being used to view a scene that includes a person wearing a fluorescent orange garment. In response to detection of the fluorescent orange color, the processing section 21 superimposes a warning 221 over the portion of the image where the fluorescent orange color was detected. In the disclosed embodiment, the warning 221 is a circle with a slash. In order to attract the attention of the user to the warning 221, the warning can be presented in a color such as red, and/or can be made to blink.

As discussed above, the warning 221 in the disclosed embodiment is a symbol in the form of a circle with a slash. Alternatively, however, the warning 221 could be some other symbol, an alphanumeric phrase, or a combination of a symbol and an alphanumeric phrase.

Although one embodiment has been illustrated and described in detail, it will be understood that various substitutions and alterations are possible without departing from the spirit and scope of the present invention, as defined by the following claims.

What is claimed is:

1. An apparatus comprising a weapon sight that includes:
structure configured to support said sight on a weapon;
a detector portion that can detect a directional orientation of said sight;
a display; and
a control portion coupled to said detector portion and said display, said control portion being responsive to said detector portion for presenting selected information on said display only when said sight has an orientation that meets an orientation criteria.

2. An apparatus according to claim 1, wherein said control portion inhibits the presentation of any information on said display unless said sight has an orientation that meets said orientation criteria.

3. An apparatus according to claim 1,
wherein said sight has a line-of-aim; and
wherein said orientation criteria includes a criteria that said line-of-aim form an angle less than 20° with respect to a vertical reference.

4. An apparatus according to claim 3, wherein said orientation criteria includes a criteria that said line-of-aim form an angle less than 10° with respect to a vertical reference.

5. An apparatus according to claim 1,
wherein said sight includes a memory; and
wherein said selected information includes image information stored in said memory.

6. An apparatus comprising a weapon sight that includes:

means for supporting said sight on a weapon;

detector means for detecting a directional orientation of said sight;

display means for providing a visual display; and control means coupled to said detector means and said display means, and responsive to said detector means for presenting selected information on said display means only when said sight has an orientation that meets an orientation criteria.

7. An apparatus according to claim 6, wherein said control means inhibits the presentation of any information on said display means unless said sight has an orientation that meets said orientation criteria.

8. An apparatus according to claim 6, wherein said sight has a line-of-aim; and wherein said orientation criteria includes a criteria that said line-of-aim form an angle less than 20° with respect to a vertical reference.

9. An apparatus according to claim 8, wherein said orientation criteria includes a criteria that said line-of-aim form an angle less than 10° with respect to a vertical reference.

10. An apparatus according to claim 6, wherein said sight includes memory means for storing information; and wherein said selected information includes image information stored in said memory means.

* * * * *